US006071448A

United States Patent [19]

Oberoi et al.

[11] Patent Number: 6,071,448

[45] Date of Patent: Jun. 6, 2000

[54] MANUFACTURE OF ROOF TILES

[76] Inventors: Bhushan Kumar Oberoi, 20 Pilgrims Way, Surrey RH2 9LG, United Kingdom; Jeffery James Palm, 7305 Fowler St., Gilroy, Calif. 95020

[21] Appl. No.: 08/981,866

[22] PCT Filed: Jul. 3, 1996

[86] PCT No.: PCT/EP96/02898

§ 371 Date: May 21, 1998

§ 102(e) Date: May 21, 1998

[87] PCT Pub. No.: WO97/02122

PCT Pub. Date: Jan. 23, 1997

[30] Foreign Application Priority Data

Jul. 5, 1995 [GB] United Kingdom ..... 9513696

[51] Int. Cl.[7] ..... B28B 7/14; B28B 11/16

[52] U.S. Cl. ..... 264/145; 264/148; 264/161; 264/163

[58] Field of Search ..... 264/145, 148, 264/151, 161, 163

[56] References Cited

U.S. PATENT DOCUMENTS

| | | |
|---|---|---|
| 4,695,418 | 9/1987 | Baker et al. . |
| 4,856,395 | 8/1989 | Smith et al. . |
| 5,108,679 | 4/1992 | Rirsch et al. . |
| 5,223,200 | 6/1993 | Schulz et al. . |

FOREIGN PATENT DOCUMENTS

| | | |
|---|---|---|
| 418791 | 12/1910 | France . |
| 80144 | 9/1894 | Germany . |
| 2757190 | 6/1979 | Germany . |
| 2950968 | 4/1981 | Germany . |
| 2198073 | 6/1988 | United Kingdom . |

*Primary Examiner*—Karen Aftergut
*Attorney, Agent, or Firm*—Rothwell, Figg, Ernst & Kurz, P.C.

[57] ABSTRACT

The present invention is directed to an improved process for the manufacture of concrete roof tiles having cut-back sidelock portions such that the tiles are flash free. The process involves the moulding of tiles on pallets which are provided with cut-away portions corresponding to the cut-back sidelock portions to be formed on the tiles and cutting the ribbon of mortar formed in a line of pallets with a knife which cuts the ribbon of mortar to form discrete tiles and to cut back the sidelock portions of the tiles at the same time. The tiles are flash free due to the action of the knife with the cut-away portions of the pallets.

1 Claim, 4 Drawing Sheets

MANUFACTURE OF ROOF TILES

This invention is concerned with improvements in or relating to the manufacture of concrete roof tiles.

Concrete roof tiles are in the main formed by the well known roller and slipper process in which tile pallets are fed seriatim beneath the mortar hopper of a tile making machine, whereat when the machine is in use, mortar is fed onto the pallets to form a continuous ribbon thereon. Downstream of the mortar hopper, a cutting mechanism of the tile making machine is operated to cut the ribbon of mortar to form discrete "green state" tiles on the individual pallets which "green state" tiles are thereafter cured by conventional means.

If other portions of the tiles are to be cut to provide cut-away portions, it is usual to provide extra knives, or the like, for severing the appropriate portion or portions. With tiles which are to be provided with side-lock portions which are cut away at "toe" and/or "head" ends of the tiles, i.e. at the lower or upper ends thereof in use, one way of achieving such a feature in the "green state" tiles is to provide an extension portion, to the knife or knives used to cut the tiles into discrete lengths, see GB 2198073B.

The novel cutting mechanism of GB 2198073B was intended to ensure that the cut-away sidelock portion of a "green state" tile is removed effectively from the remainder of the tile such that the tile is undamaged and little or no detritus remains on the tile.

This problem was only partially overcome by the use of the cutting mechanism of GB2198073B and remains particularly evident in extruded concrete tiles due to the nature of the material from which the tiles are made since the materials may vary considerably from plant to plant depending upon the grades of sands, etc., which are available for the manufacture of concrete roofing tiles.

In addition, because the knife of the cutting mechanism cuts onto the tile pallet in blanking out a sidelock feature in the tile produced thereon, a residual "flash" is evident around the bottom edge of the "green state" tile and particularly in the corner area of the cut-out sidelock feature, which "flash" may interfere with the laying of the cured tiles unless a roofer deflashes the tile.

Of late, it has become convenient to manufacture some concrete tiles upside down on their tile pallets, i.e. by forming the upper surface thereof, in use on a roof, on the tile pallet and forming the undersurface by the conventional roller and slipper method. Where such tiles are also provided with a cut-back sidelock feature, the "flash" manifests itself around and particularly at the corner area of the cut-out feature of the tile.

Thus, if a flash has to be removed from the cured tile before use, in addition to the extra deflashing operations the tiles may be impaired at their upper surface adjacent the cut-back sidelock portion to the detriment of the aesthetic appeal of the tiles laid on a roof.

It is thus one of the objects of the present invention that these disadvantages be mitigated or overcome. To this end, the present invention provides a process for the manufacture of roof tiles with cut-back sidelock portions comprising the steps of:

a) feeding a series of pallets seriatim beneath a hopper containing tile mortar;

b) causing the tile mortar to be fed from the hopper onto the series of pallets to form a continuous ribbon of mortar thereon; and, c) causing the operation of a cutting mechanism whereby a knife controlled thereby severs the ribbon of mortar at the joints between successive pallets of the series of pallets;

characterised in that the pallets used in the process are provided with cut-away portions at a corner portion thereof coincident with cut-away portions of roof tiles formed on said pallets during said process.

Preferably, the invention provides a process according to the last preceding paragraph further characterised by the function of the cutting mechanism, operation of which when the process is effected, causes the knife controlled thereby to cut completely through the mortar at the cut-away corner portions of the pallets to provide "green state" tiles with flash-free cut-back sidelock portions.

Conveniently, the invention also provides a pallet for use in the manufacture of a cut-back sidelock roof tile, said pallet comprising a cut-away portion to facilitate, in use, the manufacture of a flash-free cut-back sidelock portion in a tile formed on said pallet.

There now follows by way of example of the present invention a detailed description of the novel process for the production of roof tiles, which description is to be read with reference to the accompanying drawings in which:

FIG. 1 is a diagrammatic side elevation of a conventional tile making machine;

FIGS. 2*a* and 2*b* are top and underside plan views respectively of a roof tile;

FIGS. 3*a* and 3*b* are top and underside plan views respectively of a pallet for the production of the tile of FIGS. 2*a* and 2*b:*

FIGS. 4*a* and 4*b* are top and underside plan views respectively of a modified pallet provided by the invention;

Figure 5:
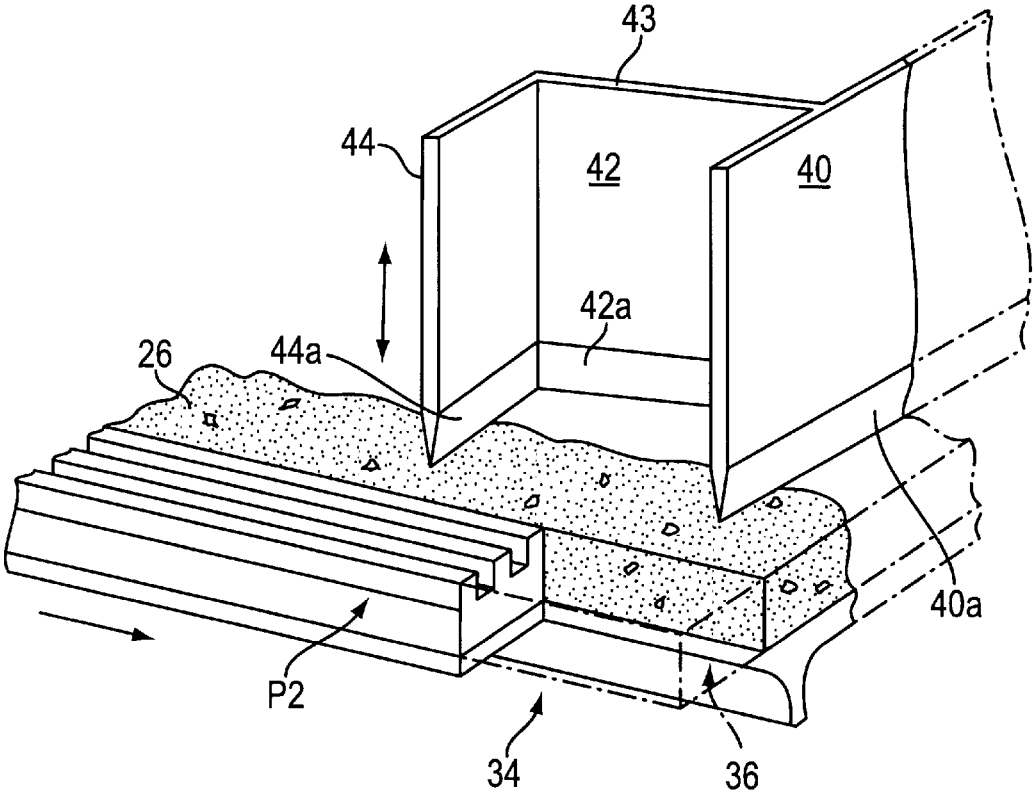
FIG. 5 is a fragmental upper perspective view of parts seen in FIG. 1.
Figure 9:
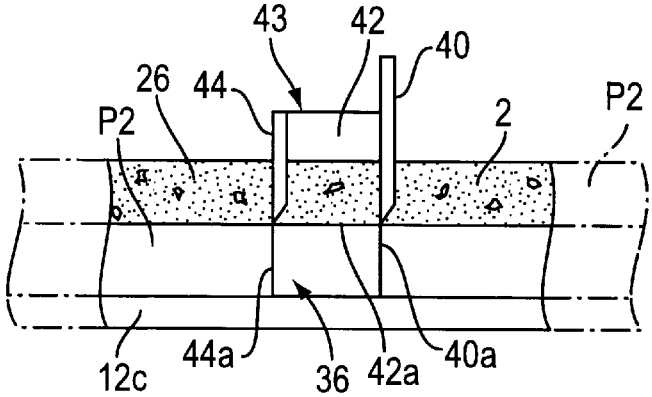
Figure 7A:
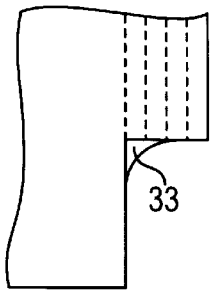
FIG. 7A (PRIOR ART)
Figure 7B:
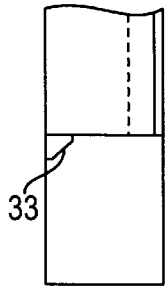
FIG. 7B (PRIOR ART)
Figure 8A:
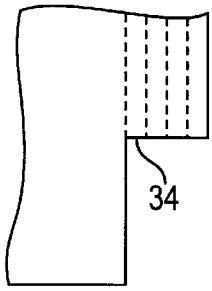
Figure 8B:
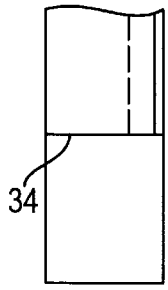

FIGS. 7*a* and 7*b* are fragmental underside and side elevations respectively of the sidelock portions of tiles formed on prior art pallets;

FIGS. 8*a* and 8*b* are fragmental underside and side elevations respectively of the sidelock portions of tiles formed on pallets of the present invention; and, FIG. 9 is a fragmental side elevation of a knife of FIG. 5 in use.

In the manufacture of concrete roof tiles by conventional tile processing methods, the cut-back sidelock feature 33, see FIGS. 7*a* and 7*b* is often embellished with a "flash" of uncut mortar. This "flash" causes difficulties when laying the tiles on a roof unless a costly "deflashing" operation is carried out. In addition, where tiles are formed upside down on their pallets, the "deflashing" operation may cause damage to the upper surface in use of the tiles adjacent the cut-back sidelock portion.

Figure 1:
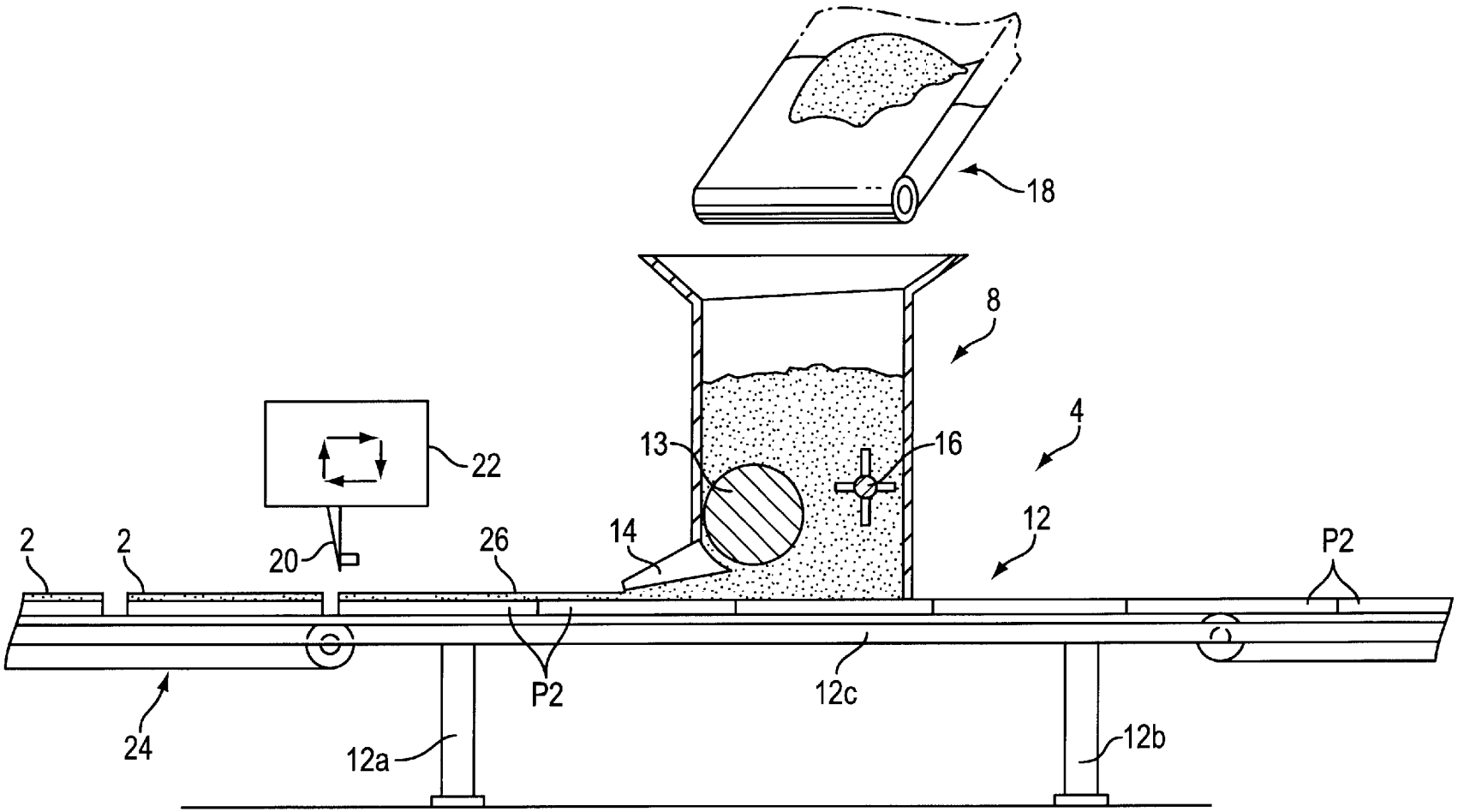
Figure 2A:
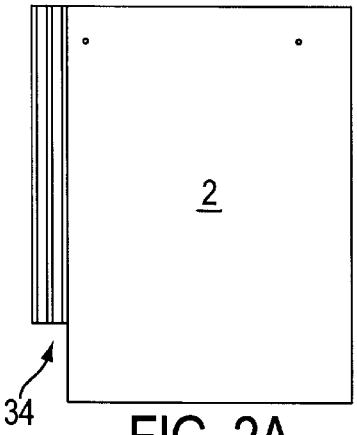
Figure 2B:
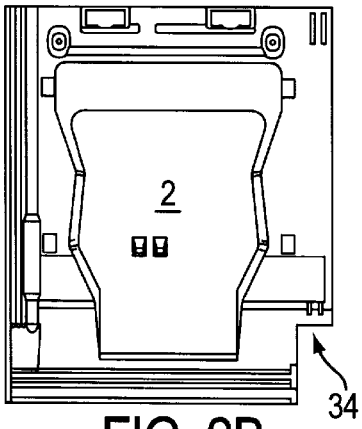

In the novel process provided by the present invention, tiles 2 are produced on a conventional tile machine 4 shown in FIG. 1, which tile machine 4 comprises a hopper 8 located overlying a pallet conveyor 12. The conveyor 12 is of conventional design, is supported on floor mounted columns 12*a* and 12*b* and comprises support rails 12*c* on which pallets P2 are supported as they pass seriatim beneath the hopper 8.

The hopper 8 is also of conventional design and provides support for a roller 13, a slipper 14 and a pack shaft 16.

Located above the hopper 8 is a material feed conveyor 18 for feeding mortar to the hopper, see FIG. 1.

Downstream of the hopper 8, the tile making machine is provided with a conventional tile cuffing knife 20 which is mounted for reciprocal vertical and longitudinal movement on a knife carriage 22 illustrated schematically in FIG. 1.

The tile making machine also comprises a pallet spacing conveyor 24 which is arranged beneath the conveyor 12 and adjacent the knife carriage 22 for accelerating pallets P2 at the head of a series of such pallets away from the remaining pallets of the series.

When the machine of FIG. 1 is in use in the manufacture of concrete roofing tiles 2, a batch of mortar is fed by the conveyor 18 to the hopper 8. At the same time, pallets P2 are fed seriatim along the support rails 12*c* of the conveyor 12 so that mortar in hopper 8 is compacted by the packshaft 16, to be thereafter formed, by the roller 13 and slipper 14, as a continuous ribbon 26 of "green state" mortar on the pallets P2.

The ribbon 26 of "green state" mortar is thereafter cut by the knife 20 of the tile cutting arrangement 22 whereupon trailing ends of the pallets P2 are engaged by the conveyor 24 whereby the "green state" tiles 2 on their associated pallets P2 are conveyed to racking devices prior to transportation to curing chambers.

Figure 3A:
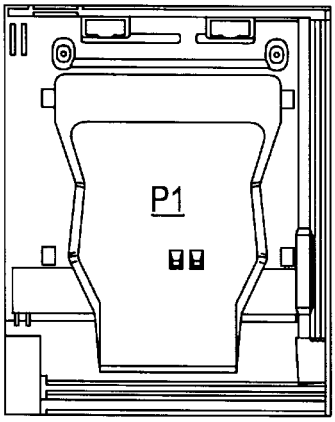
FIG. 3A (PRIOR ART)
Figure 3B:
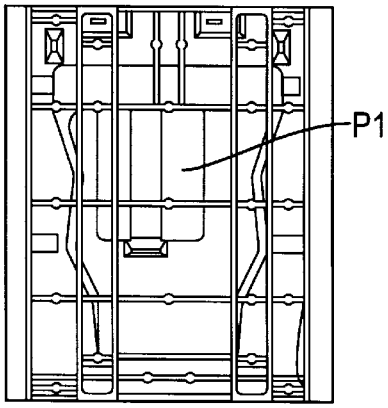
FIG. 3B (PRIOR ART)

If the tiles 2 are produced on pallets P1 as used hitherto, see FIGS. 3*a* and 3*b*, a residual "flash" 33 is evident at a lower edge portion 30 of a cut-back sidelock portion 32 of the tile 2, see especially FIGS. 7*a* and 7*b*.

This "flash" feature hinders the current laying of the tile and has to be removed by a deflashing operation before the tiles 2 can be used.

The pallets P2 of the present invention, on the other hand, enable the production of "flash" free cut-away sidelock portions 34, see especially FIGS. 8*a* and 8*b*.

Figure 4A:
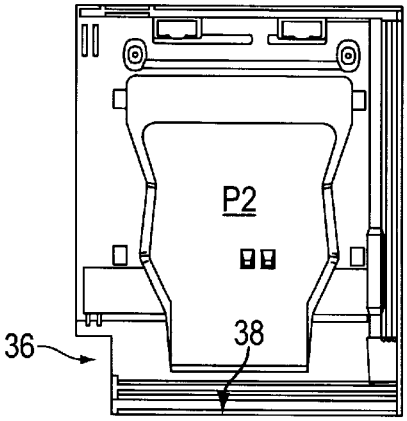
Figure 4B:
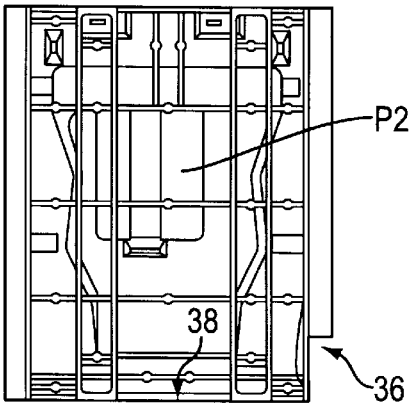

The "flash" free portions 34 are produced by using the pallets P2, which are themselves provided with a cut-away portion 36 at a lower end portion 38 of the tile, see FIGS. 4*a* and 4*b*. The cut-away portions 36 of the pallets P2 are coincident with the to be cut-away sidelock portions 34 of the tile 2 formed on said pallets P2.

To delineate and cut out said sidelock portions 34, the knife 20 comprises a first blade portion 40 for effecting the cutting of the ribbon of mortar 26 at a joint of successive pallets P2.

Figure 6:
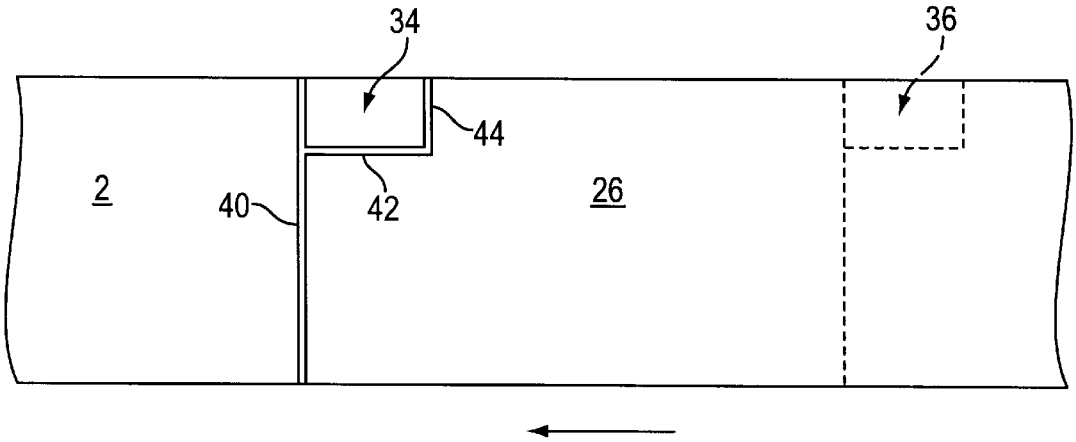
FIG. 6 is a fragmental diagrammatic plan view of parts seen in FIGS. 1 and 5.

The knife 20 also comprises a second blade portion 42 extending rearwardly at an angle normal to or substantially normal to the portion 40 as shown in FIGS. 5 and 6.

The knife 20 further comprises a third blade portion 44 extending from a rearward end 43 of the blade portion 42 at an angle normal to or substantially normal to the portion 42 and parallel to, or substantially parallel to, the blade portion 40, see FIGS. 5 and 6.

Lower end portions 40*a*, 42*a* and 44*a*, i.e. the cutting portions of the blade portions 40, 42 and 44 are conventionally arranged in the same plane to effect the cutting of the portion 34. This facilitates the complete cutting away of the sidelock portions 34 of the tiles 2 when the portion 40*a* has cut through the ribbon of mortar 26 to a depth coincident with upper surfaces of the pallets P2, see FIG. 9.

It will be readily appreciated that when forming tiles upside down, the present invention facilitates the forming of "flash"-free cut-away sidelock portions in the finished products thereby obviating the need to perform a deflashing operation which in the past has led to the upper surfaces, in use, of the tiles being damaged.

What is claimed is:

1. A process for the manufacture of roof tiles (2) with flash-free cut-back sidelock portions (34) comprising the steps of:

(a) feeding a series of pallets (P2) seriatim beneath a hopper (8) containing tile mortar;

(b) causing the tile mortar to be fed from the hopper (8) onto the series of pallets (P2) to form a continuous ribbon (26) of mortar thereon; and, (c) causing the operation of a cutting mechanism (22) wherein a knife (20) controlled thereby severs the ribbon (26) of mortar at joints between successive pallets (P2) of the series of pallets to form the roof tiles with flash-free cut-back sidelock portions;

wherein the operation of the cutting mechanism (22) causes the knife (20) controlled thereby to cut completely through the mortar at cut-away portions (36) of the pallets (P2) to provide the roof tiles (2) with the flash-free cut-back sidelock portions (34) and wherein the pallets (P2) have the cut-away portions (36) at corner portions (38) thereof coincident with the cut-back sidelock portions (34) of the roof tiles (2) formed on the pallets (P2) during the process and the knife (20) has portions coincident with the cut-away portions (36) of the pallets (P2) to form the flash-free cut-back sidelock portions on the roof tiles.

* * * * *